US009416601B2

(12) United States Patent
Mullins et al.

(10) Patent No.: US 9,416,601 B2
(45) **Date of Patent: *Aug. 16, 2016**

(54) TOP DRIVE OPERATED CASING RUNNING TOOL

(71) Applicant: DrawWorks LP, Boling, TX (US)

(72) Inventors: Albert Augustus Mullins, Boling, TX (US); Matthew J. Hickl, El Maton, TX (US)

(73) Assignee: DrawWorks LLP, Boling, TX (US)

( * ) Notice: Subject to any disclaimer, the term of this patent is extended or adjusted under 35 U.S.C. 154(b) by 259 days.

This patent is subject to a terminal disclaimer.

(21) Appl. No.: 14/056,362

(22) Filed: Oct. 17, 2013

(65) Prior Publication Data

US 2015/0107385 A1 Apr. 23, 2015

(51) Int. Cl.
*E21B 19/06* (2006.01)
*E21B 19/07* (2006.01)

(52) U.S. Cl.
CPC ..... *E21B 19/07* (2013.01); *E21B 19/06* (2013.01); *Y10T 74/18056* (2015.01); *Y10T 74/18728* (2015.01)

(58) Field of Classification Search
CPC ..... F16H 25/20; F16H 25/2003
See application file for complete search history.

(56) References Cited

U.S. PATENT DOCUMENTS 5,971,079 A 10/1999 Mullins
6,173,777 B1 1/2001 Mullins
6,311,792 B1 11/2001 Scott et al.
6,536,520 B1 * 3/2003 Snider ..... E21B 19/07 166/77.51
6,578,632 B2 6/2003 Mullins
7,028,769 B2 4/2006 Mullins
7,665,515 B2 2/2010 Mullins
7,896,111 B2 3/2011 Slack
7,909,120 B2 3/2011 Slack
8,424,939 B2 4/2013 Slack
2004/0216924 A1 11/2004 Pietras et al.
2006/0118293 A1 * 6/2006 Juhasz ..... E21B 19/07 166/77.51
2009/0321086 A1 * 12/2009 Zimmermann ..... E21B 19/07 166/379
2011/0174483 A1 7/2011 Odell, II et al.
2014/0116686 A1 * 5/2014 Odell, II ..... E21B 19/165 166/250.01
2014/0131052 A1 * 5/2014 Richardson ..... E21B 19/16 166/380
2015/0107851 A1 * 4/2015 Mullins ..... E21B 19/07 166/378

* cited by examiner

*Primary Examiner* — William P Neuder
(74) *Attorney, Agent, or Firm* — Steve Rosenblatt

(57) ABSTRACT

A casing running tool is connected to a top drive with a clutch that operates with set down weight against a spring resistive force. Setting down weight with rotation in a first direction raises an actuation member that pushes the slips out radially. The weight of the string then keeps the slips in position so that the string can be picked up and the rig floor slips removed followed by lowering the string while circulating and rotating. With slips set inside the joint and the string hanging free, rotating the top drive rotates the string as the string is lowered. With slips again supporting the string on the rig floor the top drive can be rotated in an opposed direction with weight set down to back off the slips and to remove it from the top joint.

18 Claims, 7 Drawing Sheets

TOP DRIVE OPERATED CASING RUNNING TOOL

FIELD OF THE INVENTION

The field of the invention is tools that assemble and deliver tubular strings into a borehole and more particularly top drive driven tools that allow circulation, makeup and movement of the string as it is assembled into the borehole.

BACKGROUND OF THE INVENTION

In the past manipulation, threading and circulation of casing or tubulars was done with a variety of tools such as fill up and circulation tools that featured a seal to the inside or the outside of the tubular to be able to pump fluid as the tubular string was lowered into the borehole or to initially fill that last segment that was added to the string before running in. Typically the handling of a joint to be added to a string was done with elevators and the threading was accomplished with tongs. Such tools are illustrated in U.S. Pat. Nos. 6,578,632; 5,971,079; 7,028,769; 7,665,515 and 6,173,777.

More recently systems have been developed that employ the top drive for rotation and axial movement of a tubular joint to be made up to an existing string and advanced into the borehole. These are rather complex devices that rely on cam pairs to convert rotation to axial movement of slips that cams the slips radially outwardly or inwardly to grip the inside or the outside of a tubular. They feature opposed cam pairs to allow slip actuation with bi-directional rotation and a lock position in between to allow for release. These designs are highly complex and expensive to produce and present complications that could require significant downtime for maintenance. The design is illustrated in U.S. Pat. Nos. 8,424,939 and 7,909,120.

The present invention enables selective grip and release of a tubular joint to thread a connection and to rotate a string while facilitating release to get the next joint in the string connected. The device may include a lower end seal preferably in the form of a cup seal and slips in a housing that respond to axial movement of an actuating member. The actuating member is connected to a clutched drive that is engaged for power delivery and disengaged with set down weight from the top drive. Drive rotation turns a thread that is engaged to the actuating member to move the actuating member axially in one of two opposed direction for radial extension or retraction of the slip segments. With the slips engaged the string can be rotated while lowered or lifted. With the string supported from the rig floor the top drive can radially allow the slips to retract with rotation. Those skilled in the art will have a better understanding of the present invention from the description of the preferred embodiment and the associated drawings while recognizing that the full scope of the invention is to be found in the appended claims.

SUMMARY OF THE INVENTION

A casing running tool is connected to a top drive with a clutch that operates with set down weight against a spring resistive force. Setting down weight with rotation in a first direction raises an actuation member that pushes the slips out radially. The weight of the string then keeps the slips in position so that the string can be picked up and the rig floor slips removed followed by lowering the string while circulating and rotating. With slips set inside the joint and the string hanging free rotating the top drive rotates the string as the string is lowered. With slips again supporting the string on the rig floor the top drive can be rotated in an opposed direction with weight set down to back off the slips and to remove it from the top joint.

DETAILED DESCRIPTION OF THE PREFERRED EMBODIMENT

Figure 1:
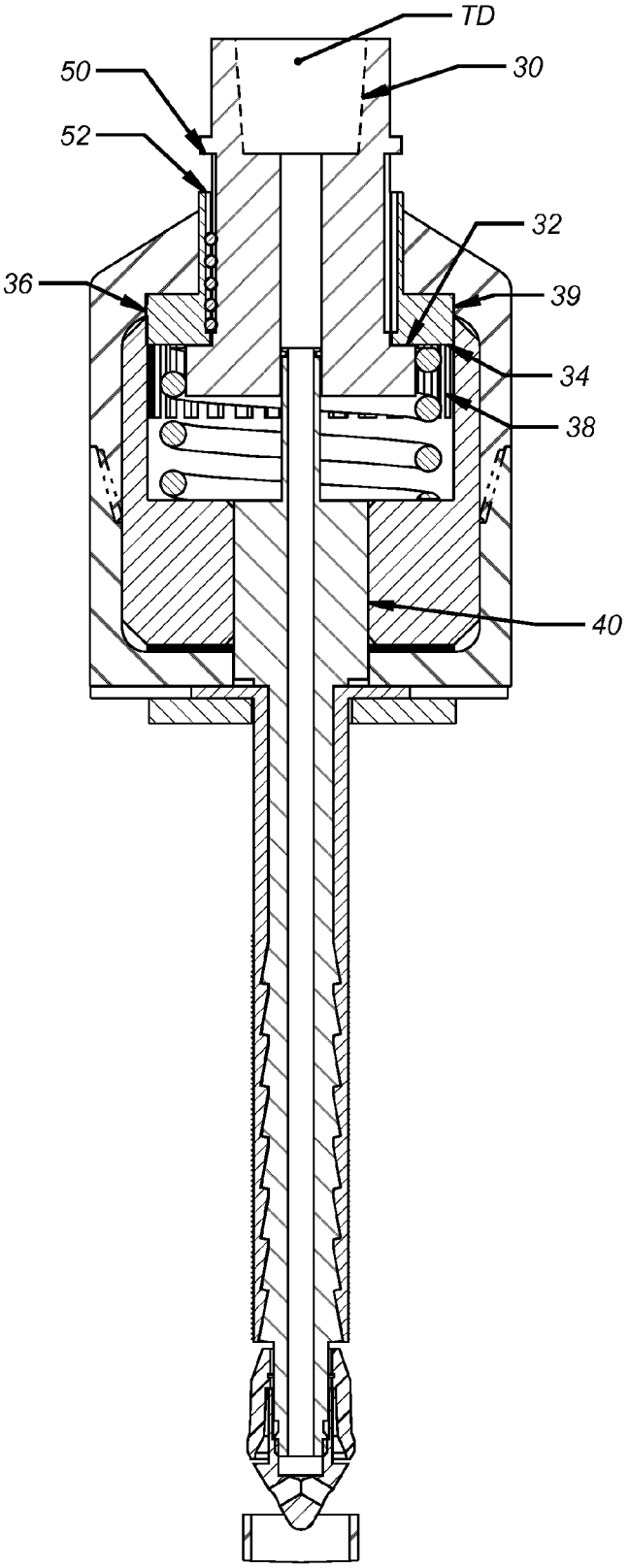
FIG. 1 shows the device in the run in position.
Figure 5:
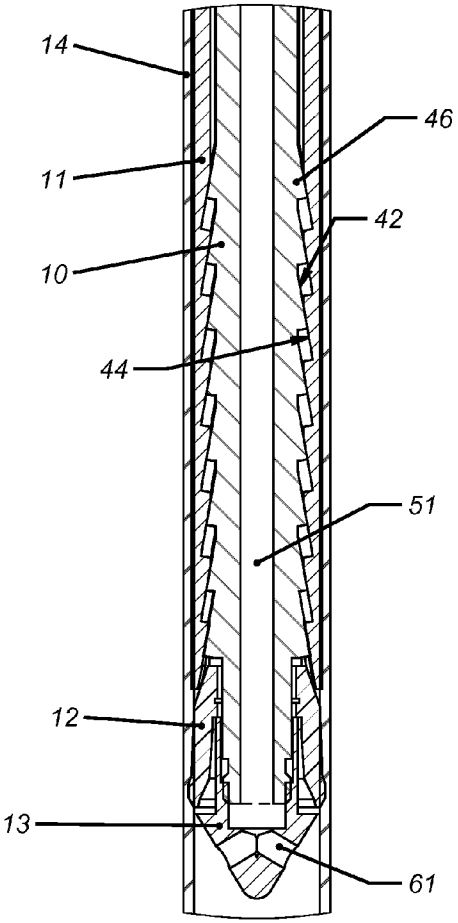
FIG. 5 shows the slips extended on the multiple ramps of the actuating member.
Figure 4:
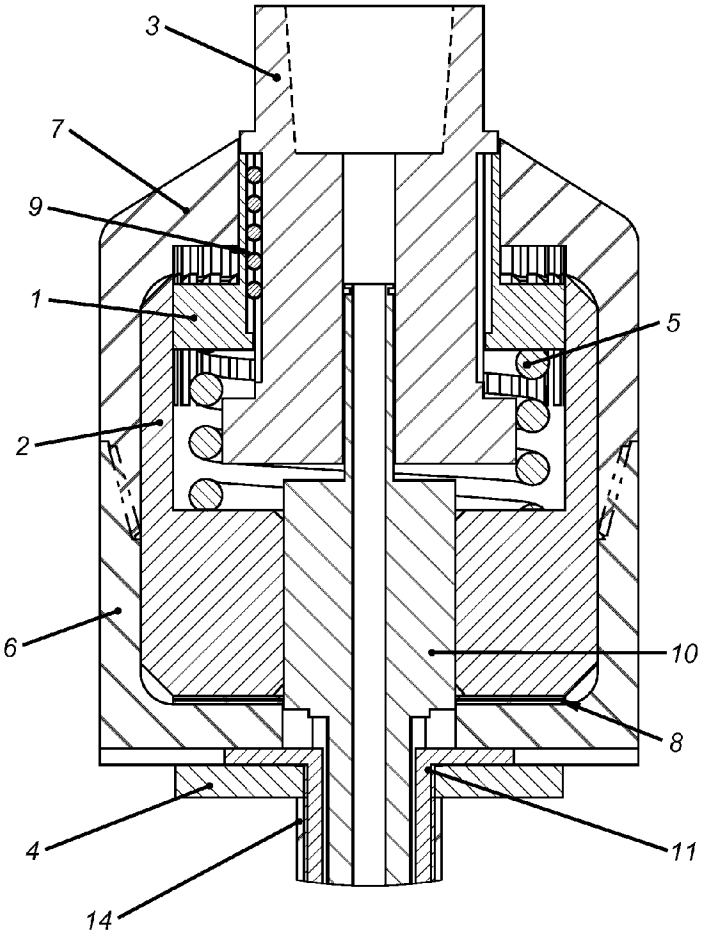
FIG. 4 shows the actuating member having moved up as a result of rotation that sets the slips.
Figure 6:
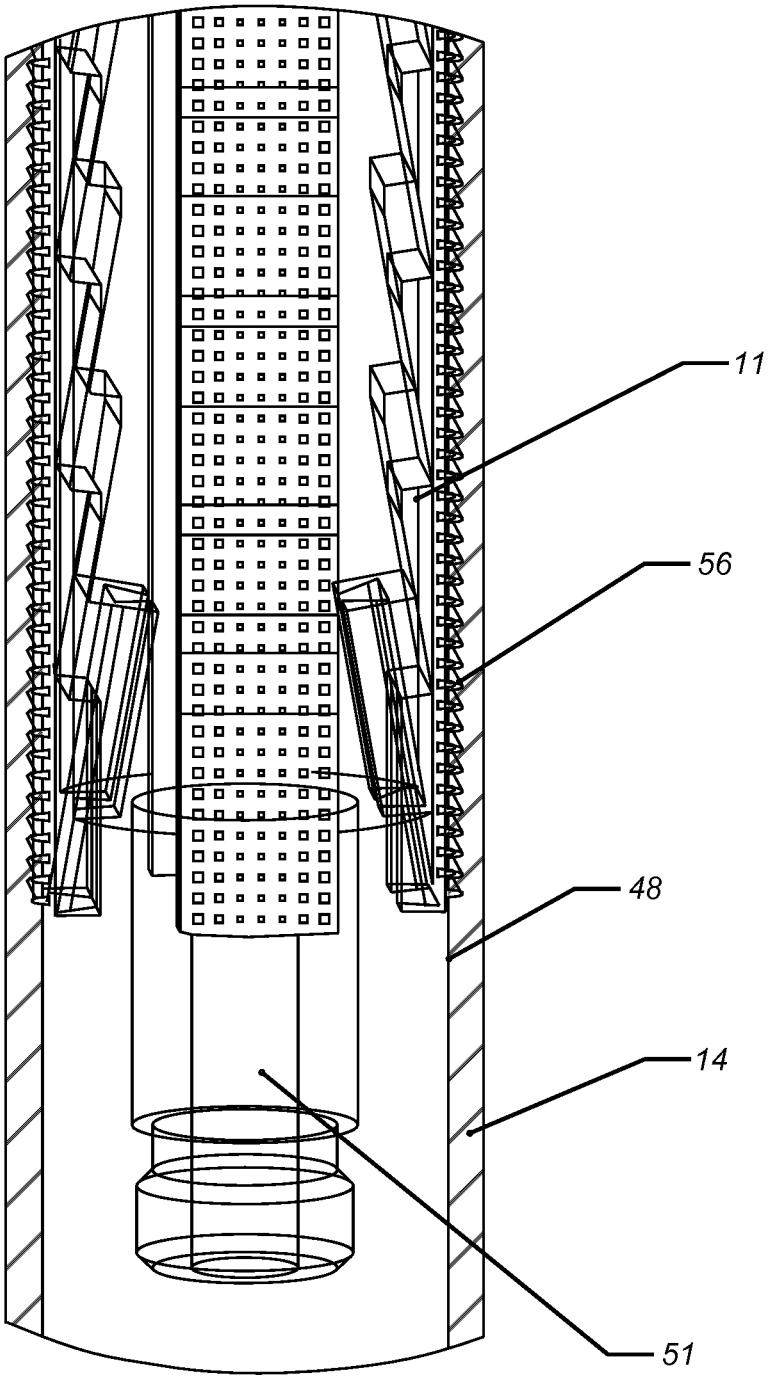
FIG. 6 is a close up showing three of four slips in the set position.
Figure 7:
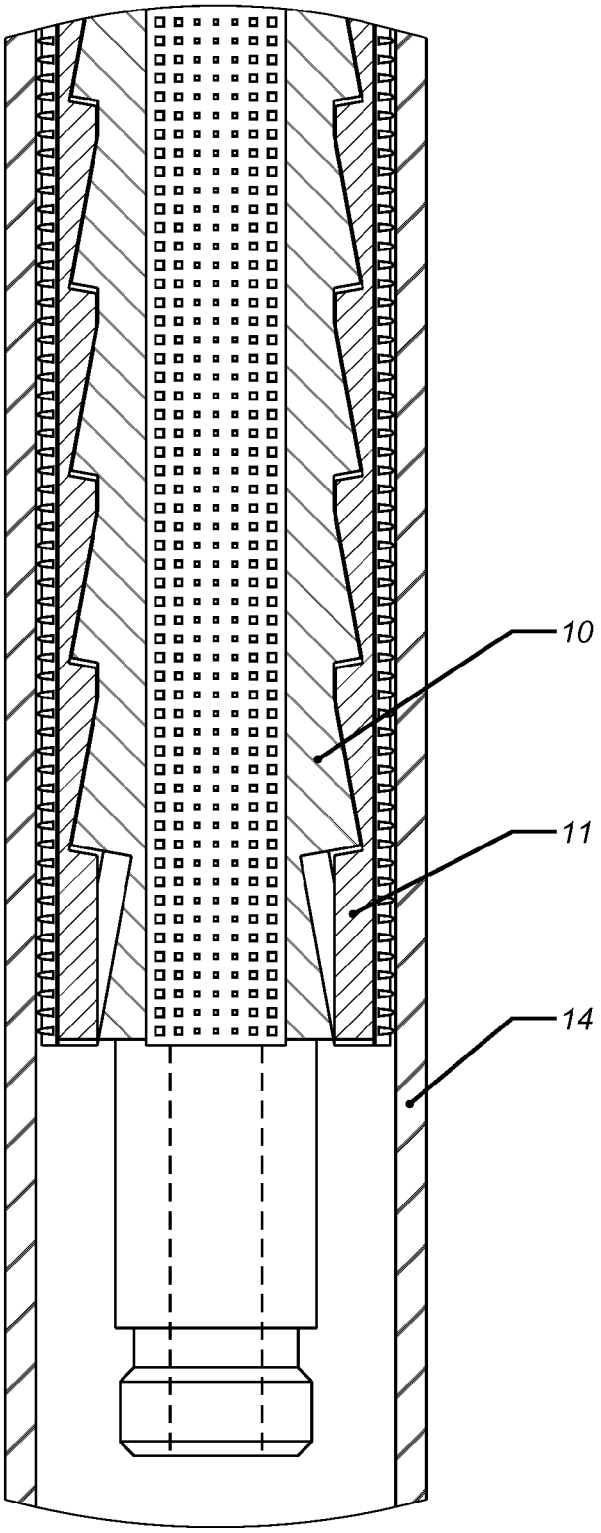
FIG. 7 is the view of FIG. 6 with the slips in the retracted position.
Figure 8:
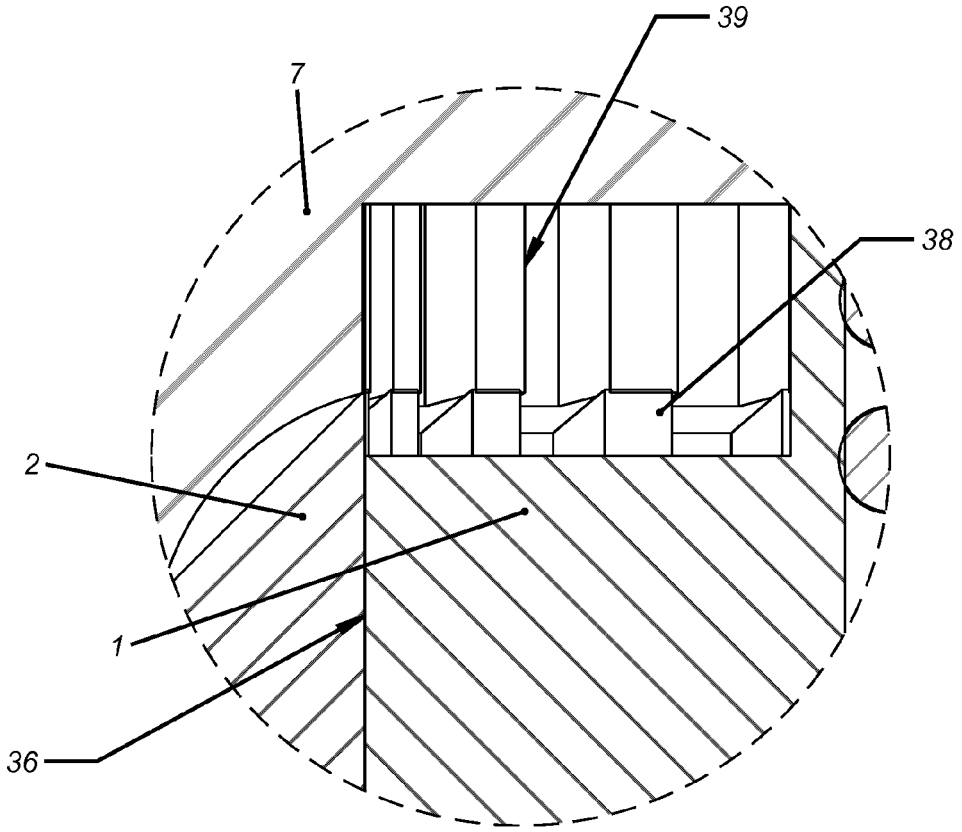
FIG. 8 is a detailed view of the spline inside the housing wall which acts as a rotational lock when there is no set down weight from the top drive.

Referring to FIG. 1 a top drive TD is schematically illustrated as supporting a top sub 3 at threads 30. The top sub 3 is rotationally locked to driving nut 1 that is captured above shoulder 32 leaving an exposed annular surface 34 on which spring 5 exerts an upward force. Driving nut 1 is rotationally locked to top sub 3 with locking balls 9 although other ways to rotationally lock can be used. Drive gear 1 has an exterior gear pattern or splines 36 that in the FIG. 1 position are engaged with an internal gear or splines 38 on driven nut or gear 2 and with splines 39 on an interior wall of the housing 7 when subjected to the force of spring 5. Splines 39 are best seen in FIG. 8 when the driving gear 1 is pushed down to expose splines 39. Driven nut 2 is mounted to rotate in housing components 6 and 7. Driven nut 2 is connected to actuator 10 at thread 40 such that rotation of the driven nut 2 by driving nut 1 through meshed splines 36 and 38 result in axial translation of actuator 10 into or out of the coils of spring 5. As better seen in FIG. 5 ramps 42 on actuator 10 engage a parallel pattern of inclined ramps 44 on slip segments 46 that are mounted for radial extension into casing 14 for contact with the interior of a casing joint 48 that is shown in FIG. 6. A flow passage 51 leads to outlets 55 for circulating fluid as the casing string is lowered into a borehole. A cup seal 12 has a downward orientation to hold pressure in the casing string 14 with returns coming back to the surface outside the casing string 14.

Figure 2:
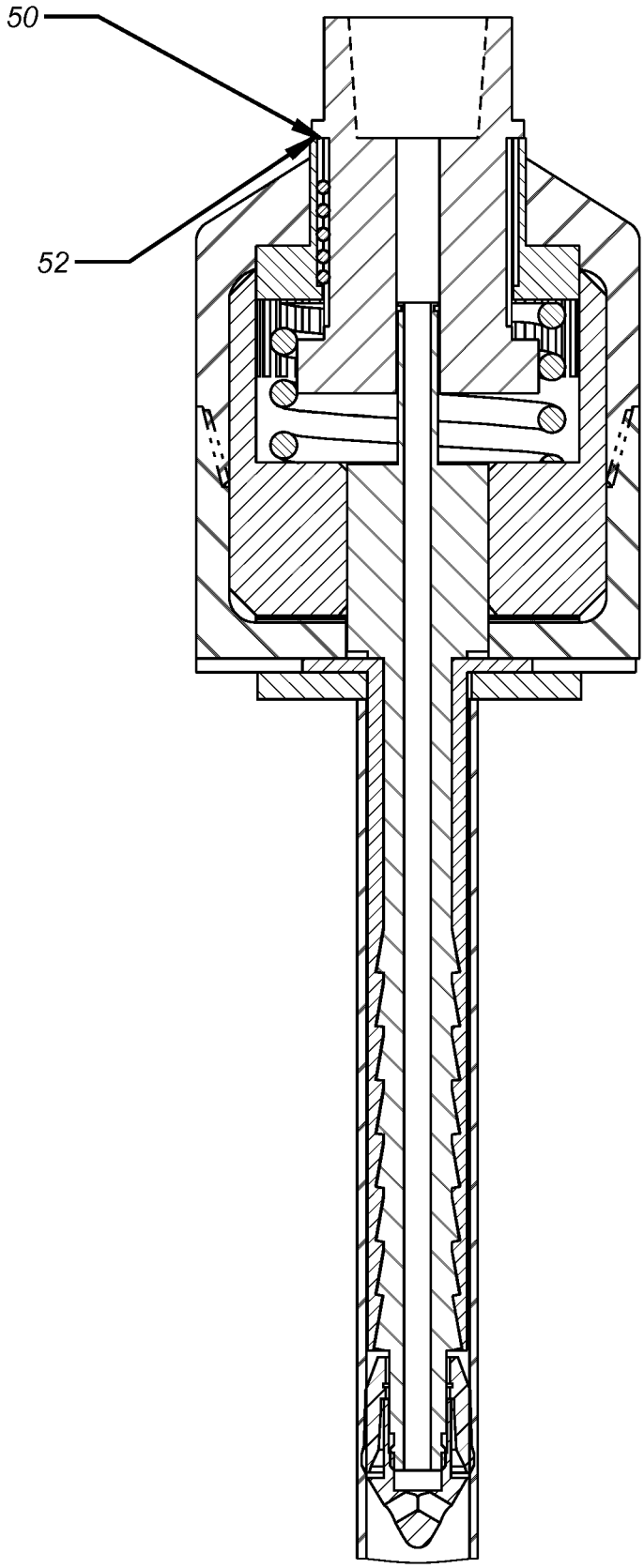
FIG. 2 is the view of FIG. 1 with weight set down before the spring is compressed.
Figure 3:
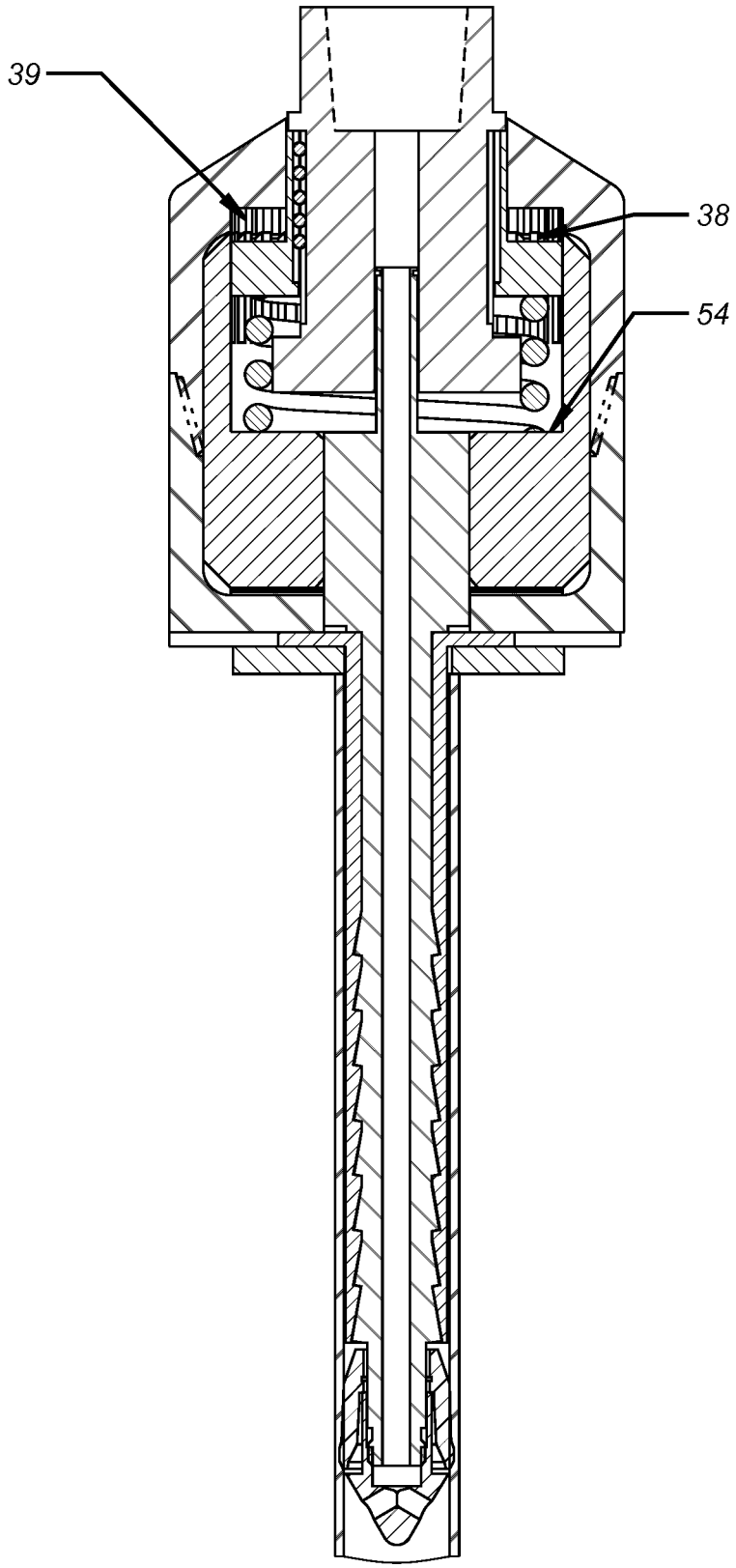
FIG. 3 is the view of FIG. 2 with the spring compressed just before rotation that will extend the slips.

To make the actuator 10 move axially, weight is set down with the top drive TD pushing the ring 50 against the top 52 of the driving nut 1, as shown in FIG. 2. Further setting down weight compresses spring 5 and moves the splines 36 out of splines 39 and only into 38 to create meshing engagement as shown in FIG. 3. Note that in this position the actuator 10 is about even with the spring support surface 54. At this point rotation of the top drive TD in one direction raises actuator 10 which pulls ramps 42 axially which results in radial movement of the slip segments 46 out until the wickers or grip profile 56 engages the tubular 14 on surface 48. With the slips segments 46 wedged into the tubular 14, the top drive TD is raised up so that the support slips in the rig floor that support the balance of the string below the tubular just threaded to the string, can be removed so that the top drive TD with slip segments 46 engaged to the tubular 48 now supports the string but splines have reengaged due to the return force of spring 5 and the fact that weight is no longer being set down as the entire string is hanging on the slip segments. At this point the splines on the driving nut 1 are engaged to splines 39 on the upper housing 7 so that top drive TD rotation simply turns the housing 6, 7 and with it the slip housing 11 that is secured to the housing 6, 7 with a fastener 4. The top drive TD can be turned in either direction with the string weight hanging without risk of release of the slips. The driller can watch the weight indicator to determine that the hanging condition of the string is maintained before operation of the top drive TD in rotation.

It should be noted that spring 5 is optional and the same result can be obtained by moving a precise distance in either or both opposed directions with the top drive to get the desired engagement that allows slip extension or tubular rotation with the weight of the string hanging off the top drive as well as the release of the slips from the string when needed.

In order to release from the string 14 after filling and circulating through the string 14 as it is advanced into the borehole, slips on the rig floor (not shown) are set to support the string 14 from the ring floor and allow weight to be set down by lowering the top drive TD so that the FIG. 3 position is resumed. At this point the top drive TD is made to rotate driving nut 1 and the driven nut 2 in the opposite direction than the direction that set the slip segments 46 to make the actuator 10 move back axially in a downhole direction to allow the slip segments to radially retract. When the actuator 10 moves down it will pull the slip segments 46 inward for a grip release.

Those skilled in the art will appreciate that spring 5 can take different forms such as a sealed volume with compressible gas inside or a stack of Bellville washers for example. The top sub 3 can be a guide for the axial movement of the actuator 10 while conducting flow through the cup seal 12. The rotational lock with balls 9 can be splines or other structures. The design is simple and can be built economically for reliable operation. Setting down weight allows extension or retraction of the slips when accompanied by rotation from the top drive. Without setting down weight and rotating the top drive with the slips extended the tubular supported by the slips turns in tandem with the housing 6,7 and the slips 11 that is non-rotatably attached to it.

We claim:

1. A top drive operated tubular running tool assembly, comprising:

a housing supported by the top drive;

a gear driven assembly in said housing to selectively transmit rotational input from the top drive and convert such rotation to axial movement of an actuator member operably linked to at least one slip for selective grip and release of the tubular by said slip;

said selective transmission of rotational input comprises a clutch.

2. The assembly of claim 1, wherein:

said gear driven assembly converts rotational input from the top drive into axial movement of said actuator member using a threaded connection therebetween.

3. The assembly of claim 1, wherein:

said gear driven assembly is selectively rotationally locked to said housing under the force of a bias.

4. The assembly of claim 1, wherein:

said actuator member drives said slip exclusively in a radial direction.

5. The assembly of claim 1, wherein:

said at least one slip has an elongated shape with a plurality of driven ramps that are in alignment with a plurality of driving ramps on said actuator member.

6. A top drive operated tubular running tool assembly, comprising:

a housing supported by the top drive;

a gear driven assembly in said housing to selectively transmit rotational input from the top drive and convert such rotation to axial movement of an actuator member operably linked to at least one slip for selective grip and release of the tubular by said slip;

said selective transmission of rotational input comprises a clutch;

said clutch is biased to a first position where rotation of the top drive will not move said actuator member axially.

7. The assembly of claim 6, wherein:

said bias is overcome with set down weight on a driving gear that at least in part acts as said clutch.

8. The assembly of claim 6, wherein:

said bias is accomplished with a coiled spring.

9. The assembly of claim 6, wherein:

axial movement of said driving gear against said bias maintains engagement with a driven gear for tandem rotation while disengaging said driving gear from said housing.

10. The assembly of claim 9, wherein:

rotation of said driven gear drives said actuator member axially.

11. The assembly of claim 10, wherein:

said driven gear is operably connected to said actuator member by a thread.

12. The assembly of claim 11, wherein:

said actuator member drives said slip exclusively in a radial direction.

13. The assembly of claim 12, wherein:

said at least one slip has an elongated shape with a plurality of driven ramps that are in alignment with a plurality of driving ramps on said actuator member.

14. The assembly of claim 12, further comprising:

a top sub adapted to be connected to the top drive and rotationally locked to said driving gear.

15. The assembly of claim 14, wherein:

said driving gear and driven gear are rotationally locked to said housing under a force provided by said biasing.

16. The assembly of claim 15, wherein:

said driving gear is released from being rotationally locked to said housing with a set down force that overcomes said biasing.

17. The assembly of claim 16, wherein:

said slip retains the tubular with said slip extended when the weight of said tubular is supported by said extended slip such that rotation of said housing by the top drive rotates the tubular.

18. The assembly of claim 14, wherein:

said top sub comprises a passage therethrough that acts as an axial movement guide for said actuator member;

said actuator member has an actuator passage therethrough so that there is flow communication through said passages in said top sub and said actuator member.

* * * * *